US006836059B2

(12) United States Patent
Smith

(10) Patent No.: US 6,836,059 B2
(45) Date of Patent: Dec. 28, 2004

(54) IMAGE INTENSIFIER AND ELECTRON MULTIPLIER THEREFOR

(75) Inventor: Arlynn Walter Smith, Blue Ridge, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 83 days.

(21) Appl. No.: 10/396,906

(22) Filed: Mar. 25, 2003

(65) Prior Publication Data

US 2004/0189166 A1 Sep. 30, 2004

(51) Int. Cl.[7] ..... H01J 43/00

(52) U.S. Cl. ..... 313/103 R; 313/528; 313/103 CM; 313/105 CM

(58) Field of Search ..... 313/523, 528, 313/532, 541, 542, 103 CM, 105 CM

(56) References Cited

U.S. PATENT DOCUMENTS 3,478,213 A 11/1969 Simon et al.
5,029,963 A 7/1991 Naselli et al.
5,084,780 A 1/1992 Phillips

OTHER PUBLICATIONS

T. Guo et al.; "Negative electron affinity (Si–$Na_2$KSb–Cs)–O–Cs photocathode", J. Appl. Phys. Lett. 58 (16), Apr. 22, 1991, pp. 1757–1758.

G. Di Cola et al.; "Numerical Calculations of the Yeild and Fano Factor According to van Roosbroeck's Statistical Model for Semiconductors", Physical Review, vol. 162, No. 3, Oct. 13, 1967; pp. 690–692.

T. Guo; "Negative electron affinity silicon heterojunction photocathodes with alkali antimonide intermediate layers", J. Appl. Phys. 72 (9), Nov. 1, 1992; pp. 4384–4389.

T. Guo; "Photoelectron emission and avalanche electron emission from shallow Si p–n juncitons", J. Appl. Phys. 72 (7), Oct. 1, 1992; pp. 3058–3063.

W. van Roosebroeck; "Theory of the Yield and Fano Factor of Electron–Hole Pairs Generated in Semiconductor by High–Energy Particles"; Physical Review, vol. 139, No. 5A; Aug. 30, 1965; pp. 1702–1716.

*Primary Examiner*—Vip Patel
(74) *Attorney, Agent, or Firm*—RatnerPrestia

(57) ABSTRACT

An image intensifier and electron multiplier therefor is disclosed. Photons of an image impinge a photo-cathode that converts the photons to electrons. An electron multiplier multiplies the electrons from the photo-cathode to create an increased number of electrons. A sensor captures the increased number of electrons to produce an intensified image. The electron multiplier is an electron bombarded device (EBD) containing a semiconductor structure. The semiconductor structure has an input surface for receiving electrons and an emission surface for passing an increased number of electrons. The semiconductor structure is doped to direct the flow of electrons through the semiconductor structure to an emission area on the emission surface.

22 Claims, 3 Drawing Sheets

IMAGE INTENSIFIER AND ELECTRON MULTIPLIER THEREFOR

FIELD OF THE INVENTION

The present invention relates to image intensifiers and, more particularly, to electron multipliers used therein.

BACKGROUND OF THE INVENTION

Image intensifiers are used in night/low light vision applications to amplify ambient light into a useful image. FIG. 1 depicts a known image intensifier tube 100. In the illustrated image intensifier tube 100, photons impinge upon a photo-cathode 102, thereby generating electron/hole pairs. A microchannel plate (MCP) 104 is positioned to receive the electrons generated by the photo cathode 102. The MCP 104 generates an increased number of electrons for each electron received from the photo-cathode 102. A phosphor screen 106 is positioned to receive the increased number of electrons and produce an image for display by the image intensifier tube 100. The photo-cathode 102, MCP 104, and phosphor screen 106 are supported by a vacuum housing 108 that maintains gaps between these devices under vacuum to facilitate the flow of electrons therebetween.

Electron-bombarded devices (EBD) are capable of multiplying electrons. FIG. 2 depicts an EBD 200, which is based on a semiconductor structure having an input surface 202 and an emission surface 204 opposite the input surface 202. Accelerated electrons 206 impinge on the input surface 202 to produce an increased number of free electrons 208 within the semiconductor structure. The increased number of electrons 208 traverse the semiconductor structure between the input surface and the emission surface where they are emitted. Additional information regarding EBDs can be found in Reflection and Transmission Secondary Emission from Silicon by R. U. Martinelli (Appl. Phys. Lett., Vol. 17, Num. 6, pp. 313-314, 1970) and in Reflection and Transmission Secondary Emission from GaAs by R. U. Martinelli et al. (J. Appl. Phys., Vol. 43, Num. 11, pp. 4803–4804, 1972).

Because EBDs 200 are semiconductor structures, they can be inexpensively produced using mature, proven semiconductor fabrication technology and have low power requirements. However, EBDs typically have poor image transfer characteristics when used for electron multiplication.

Accordingly, an inexpensive, low power electron multiplier having improved image transfer capability is needed for use in devices such as image intensifiers. The present invention fulfills this need among others.

SUMMARY

The present invention provides an image intensifier and an electron multiplication method and apparatus therefor. The method in accordance with the present invention includes creating an increased number of electrons within a semiconductor device having an input surface and an emission surface opposite the input surface and directing the increased number of electrons to an emission area for emission from the emission surface. The apparatus in accordance with the present invention includes a semiconductor structure having an input surface for receiving electrons and an emission surface opposite the input surface, the semiconductor structure generating an increased number of electrons responsive to the received electrons. The semiconductor structure is doped to direct the increased number of electrons to at least one emission area on the emission surface, each of the at least one emission areas associated with a corresponding region of the input surface.

BRIEF DESCRIPTION OF THE DRAWINGS

The invention is best understood from the following detailed description when read in connection with the accompanying drawings. This emphasizes that according to common practice, the various features of the drawings are not drawn to scale. On the contrary, the dimensions of the various features are arbitrarily expanded or reduced for clarity. Like numerals are used to represent like elements among the figures. Included in the drawings are the following features.

DETAILED DESCRIPTION OF THE INVENTION

Figure 1:
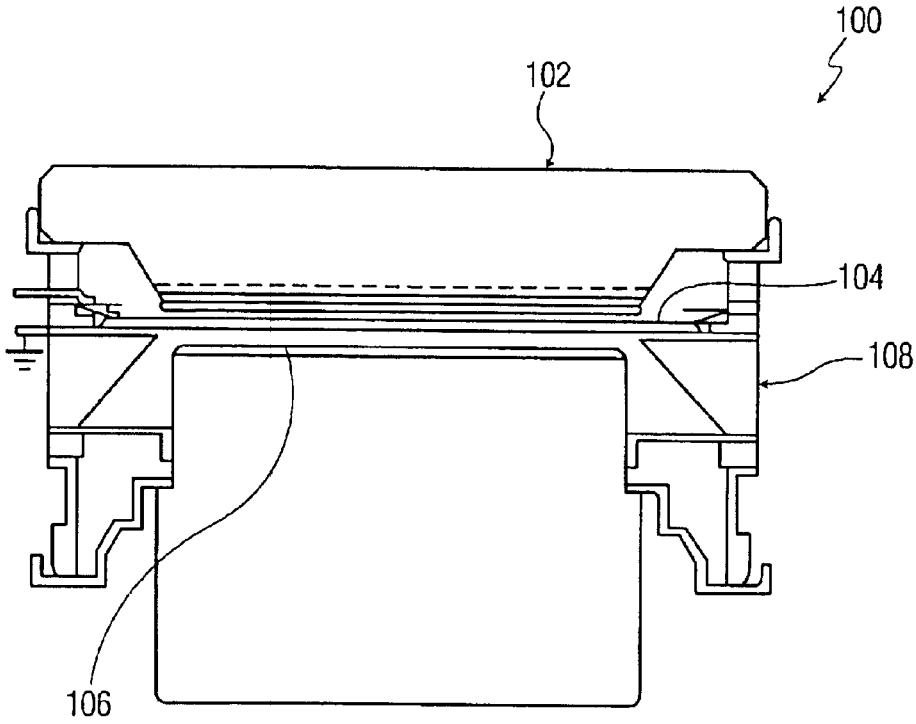
FIG. 1 PRIOR ART
FIG. 1 is an illustration of a prior art image intensifier.
Figure 2:
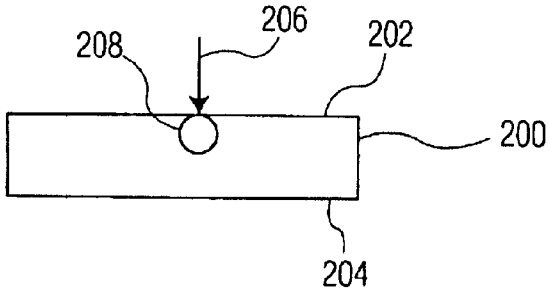
FIG. 2 is a cross-sectional view of a semiconductor structure for multiplying electrons.
Figure 3:
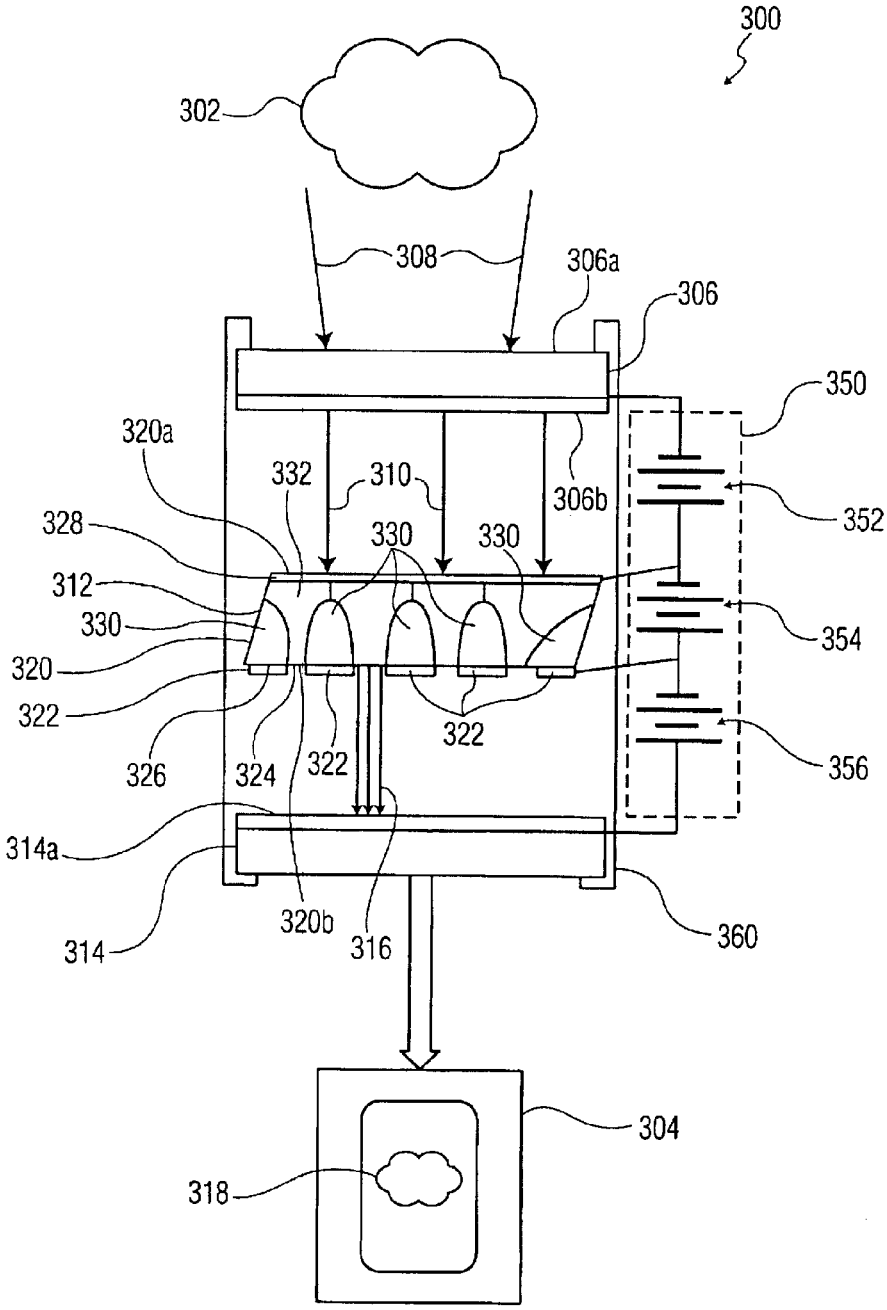
FIG. 3 is an illustration of an image intensifier in accordance with the present invention.

FIG. 3 is a schematic representation of an image intensifier tube 300 (hereinafter "image intensifier") for intensifying an image 302 for display on a display device 304 in accordance with an exemplary embodiment of the present invention. In a general overview, the illustrated image intensifier 300 includes a photo-cathode 306 for converting photons 308 of an image 300 into free electrons 310, an electron bombarded device (EBD) 312 for increasing the number of free electrons, and a sensor 314 for sensing the increased number of free electrons 316 to produce an intensified image 318 on the display device 304. Although the EBD 312 of the present invention may be used in essentially any application where electron multiplication is needed, it is especially useful in image intensifiers found in state of the art night vision devices. Accordingly, the present invention is described in conjunction with its use in an image intensifier 300 such as those used in night vision devices.

The photo-cathode 306 includes an input surface 306*a* and an output surface 306*b*. When photons 308 impinge the input surface 306*a* of the photo-cathode 306, each impinging photon 308 has a probability to create a free electron. Free electrons 310 resulting from impinging photons 308 pass through the photo-cathode 306 and are emitted from the output surface 306*b*. The output surface 306*b* is activated to a negative electron affinity (NEA) state in a well-known manner to facilitate the flow of the electrons 310 from the output surface 306*b* of the photo-cathode 306. The peripheral surface of the photo-cathode 306 is coated with a conducting material (not shown), such as chrome, to provide an electrical contact to the photo-cathode 306.

In an exemplary embodiment, the photo-cathode 306 is a conventional photo-cathode device made from semiconductor materials such as gallium arsenide (GaAs) which exhibit a photo emissive effect. It is noted that other III-V materials can be used such as GaP, GaInAsP, InAsP, InGaAs, etc. Alternatively, the photo-cathode may be a known Bi-alkali. In the exemplary photo-cathode 306, the photo-emissive semiconductor material absorbs photons. The absorbed photons cause the carrier density of the semiconductor material to increase, thereby causing the material to generate a photo-current of electrons 310 passing though the photo-cathode 306 for emission from the output surface 306*b*.

The EBD 312 multiplies the electrons emitted from the output surface 306*b* of the photo-cathode 306. The illustrated EBD 312 includes a doped semiconductor structure 320 (hereinafter "semiconductor structure") and a blocking structure 322. The semiconductor structure 320 has an input surface 320*a* and an emission surface 320*b* opposite the input surface 320*a*. As described in detail below, the semiconductor structure 320 is doped, e.g., in a first doped region 328 and a second doped region 330, to direct the flow of electrons 316 to emission areas (represented by emission area 324) on the emission surface 320*b*. Thus, the doped regions predefine the emission areas 324. The emission areas 324 are activated to a negative electron affinity (NEA) state in a well-known manner to facilitate the flow of electrons from the emission areas 324 of the semiconductor structure 316. In an exemplary embodiment, the semiconductor structure 316 is silicon and is approximately 20–30 microns thick. Alternatively, the semiconductor structure 316 may be another type of semiconductor material such as GaAs.

The blocking structure 322 produces blocking areas (represented by blocking area 326) on the emission surface 320*b*. The blocking areas 326 inhibit the flow of electrons into and out of the semiconductor structure 320 through the emission surface 320*b*, thereby maintaining spatial fidelity. Also, as described below, when employed, the blocking structure 322 may perform a number of functions in addition to blocking the flow of electrons. In certain exemplary embodiments, it is contemplated that the semiconductor structure 320 will provide suitable electron multiplication without a blocking structure 322. In accordance with these embodiments, the blocking structure 322 may be eliminated.

Figure 3A:
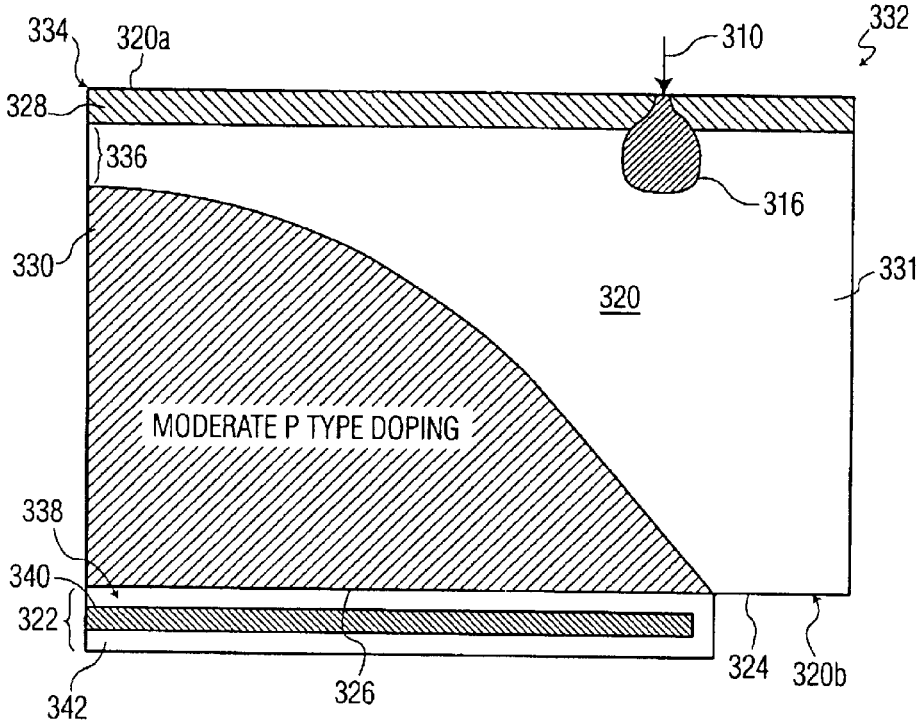
FIG. 3A is an enlarged sectional view of one-half of one cell of the electron multiplier of FIG. 3.

The EBD 312 includes a plurality of electron bombarded cells (EBCs), represented by EBC 332. FIG. 3A depicts an enlarged sectional view of one-half of one EBC 332 for use in describing the semiconductor structure 320 and blocking structure 322 in detail. In the illustrated EBC 332, a first doped region 328 is in contact with the input surface 320*a* of the semiconductor structure 320 and a second doped region 330 is in contact with the emission surface 320*b* and extends toward the input surface 320*a*. The blocking structure 322 is disposed on the emission surface 320*b* of the semiconductor structure 320 in the blocking area 326, which corresponds to the second doped region 330.

Electrons 310 that impinge the input surface 320*a* of the EBC 332 create an increased number of electrons 316. The first doped region 328 is doped to force the increased number of electrons 316 away from the input surface 320*a* into the semiconductor structure 320, thus inhibiting recombination of electrons at the input surface 320*a*. Inhibiting the recombination of electrons at the input surface ensures that more electrons flow through the semiconductor structure to the emission surface 320*b*, thereby increasing efficiency. In an exemplary embodiment, the first doped region 328 is doped with a conventional p-type dopant such as boron or aluminum for a semiconductor structure 320 of silicon. In the exemplary embodiment, the first doped region 328 is heavily doped, e.g., $10^{18}$ or $10^{19}$ parts per cubic centimeter, and is approximately 100–300 nanometers deep. Other suitable dopants, concentrations, and dimensions for use with silicon semiconductors and other semiconductor materials, e.g., GaAs, will be readily apparent to those skilled in the art of semiconductor fabrication. In an exemplary embodiment, the peripheral surface of the EBD 312 (FIG. 3) is coated with a conducting material (not shown), such as chrome, adjacent to the first doped region 328 to provide an electrical contact to the front surface of the EBD 312.

The second doped region 330 is doped to direct the increased number of electrons 316 toward the emission areas 324. The second doped region 330 acts as a funnel to channel the increased number of electrons 316, which may be generated from electrons that impinge essentially anywhere upon the input surface 320*a*, to the emission areas 324 on the emission surface 320*b*. The doped region 330 defines a channel region 331 that extends from the input surface 320*a* to the emission area 324. The channel region 331 has a wider cross-sectional area near the input surface 320*a* that narrows as it approaches the emission area 324. In an exemplary embodiment, the second doped region 330 is moderately doped with a conventional p-type dopant such as boron or aluminum for a silicon semiconductor structure, e.g., $10^{17}$ parts per cubic centimeter, and has a thickness that varies from about 24 microns at the intersection 334 between EBCs to zero near the emission area 324. Other suitable dopants, concentrations, and dimensions for use with silicon semiconductors and other semiconductor materials, e.g., GaAs, will be readily apparent to those skilled in the art of semiconductor fabrication.

In the exemplary embodiment, a gap 336 exists between the first doped region 328 and the second doped region 330. The gap 336 is sized such that the second doped region 330 does not interfere with the generation of the increased number of electron 316 at the input surface 320*a*, thereby enabling the EBC 332 to have an effective electron multiplication area approaching 100%, e.g., up to 100%. In one exemplary embodiment, the gap 336 is approximately one micron.

The illustrated blocking structure 322 includes a first oxide layer 338 disposed on the emission surface 320*b* of the semiconductor structure 320, a metal layer 340, e.g., aluminum, disposed on the first oxide layer 338, and a second oxide layer 342 disposed on the metal layer 340. In an exemplary embodiment, the layers of the blocking structure 322 are fabricated on the semiconductor structure 320 using conventional fabrication techniques that are readily apparent to those of skill in the art. In one exemplary embodiment, the first oxide layer 338 is approximately 100–300 nanometers thick, the metal layer 340 is approximately 100–300 nanometers thick, and the second oxide layer 342 is approximately 100–300 nanometers thick. In accordance with this embodiment, the total thickness of the blocking structure 322 is approximately 300–900 nanometers.

The layers of the illustrated blocking structure 322 perform a variety of functions in the exemplary embodiment. The first oxide layer 338 prohibits the emission of electrons from the emission surface 320*b* of the semiconductor structure 320 in areas where it is deposited, thereby reducing any "dark current" by the ratio of area blocked by the first oxide layer 338, i.e., the blocked area 326, to the total area of the emission surface 320*b*. Dark current is the flow of electrons within the semiconductor structure 316 produced by thermal variations of the semiconductor structure 316, which creates noise in the EBD 312.

In an exemplary embodiment, the metal layer 340 is biased to draw the increased number of electrons 316 toward it through the semiconductor structure 320. In an exemplary embodiment, the metal layer 340 biased such that the thickness of the semiconductor structure is decreased to the electron diffusion length. In the exemplary embodiment, the biasing is low, e.g., less than one volt, to prevent electrons from gaining enough energy to penetrate the second doped region 330 and prevent damage to the semiconductor structure 320. In addition, the metal layer 340 acts as a blocking layer for light feed back in embodiments where a photo-emitter or phosphor screen is used as a sensor 314 (FIG. 3). The metal layer 340 absorbs/reflects photons originating from such devices to prevent the photons from reaching the photocathode 306 through the emission surface 320*b* of the semiconductor structure 320 in areas blocked by the metal layer 340, thus reducing noise do to light feed back from the sensor 314.

The second oxide layer 342 is disposed on the metal layer 340 to inhibit the emission of electrons by the metal layer 410. Thus, noise attributable to the metal layer 340 is reduced.

Figure 4:
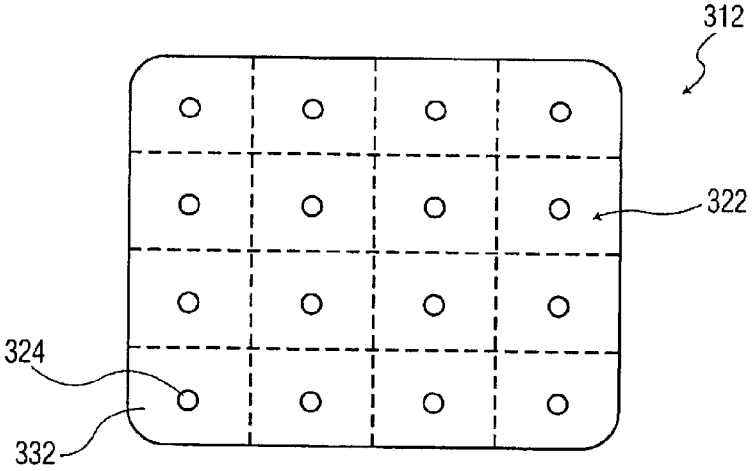
FIG. 4 is a bottom view of an electron multiplier for use in the image intensifier of FIG. 3.

FIG. 4 depicts a bottom view of the EBD 312. The illustrated emission areas 324 are geometric shapes (e.g., circles) defined by the blocking structure 322. Although circles are illustrated, the emission areas 324 may be squares or essentially any geometric shape. In an exemplary embodiment, the blocking structure 322 extends for 10–20 microns between emission areas 324 and the emission areas 324 are 0.5–2.0 microns in diameter. Thus, in accordance with this embodiment, the blocking structure 322 covers more than 80% of the emission surface 320*b* (FIG. 3) of the semiconductor structure 320.

The individual EBCs 332 form an array within the EBD 312. The illustrated array is square, however, the array may take other geometric shapes, e.g., circular or rectangular, depending upon the format of the input and/or output electrons (e.g., circular for lens compatibility and square/rectangular for integrated circuit compatibility). In an exemplary embodiment, to replicate a conventional micro channel plate used in an image intensifier tube, a square array exceeding 3000×3000 EBCs 332 would be used. Each of the EBCs 332, and their associated emission areas 324, correspond to regions of the input surface 320*a* such that the array of EBCs 332 pixellate the electrons received at the input surface 320*a* of the semiconductor structure 320. The number of EBCs 332 actually employed in an array may be many more or less depending on the size of the individual EBCs 332 and the desired resolution of the image intensifier 300.

Referring back to FIG. 3, the sensor 314 receives the increased number of electrons from the EBD 312 at an input surface 314*a*. In an exemplary embodiment, the sensor 314 is a conventional integrated circuit having a CMOS substrate and a plurality of collection wells commonly used in prior art image intensifier tubes. Electrons collected in the collection wells are processed using standard signal processing equipment for CMOS sensors to produce an intensified image signal that is sent through an output to a conventional image display device 304. In an alternative embodiment, the sensor 310 is a phosphor screen that converts the increased number of electrons to photons directly. The peripheral surface of the sensor 314 is coated with a conducting material (not shown), such as chrome, to provide an electrical contact to the sensor 314.

A biasing circuit 350 provides biasing current to the image intensifier 300. The biasing circuit 350 includes a first electrical circuit 352, a second electrical circuit 354, and a third electrical circuit 356. The first electrical circuit 352 provides a biasing voltage between the photo-cathode 306 and the EBD 312, the second electrical circuit 354 provides a biasing voltage between the input surface 320*a* of the semiconductor structure 320 and the metal layer 340 (FIG. 3A) of the blocking structure 322, and the third electrical circuit 356 provide a biasing voltage between the EBD 312 and, the sensor 314.

A vacuum housing 360 houses the photo-cathode 306, EBD 312, and sensor 314. In a preferred embodiment, the photo-cathode 306 and the EBD 312 are positioned within the housing 360 such that the output surface 306*a* of the photo-cathode 306 is in close proximity to the input surface 320*a* of the semiconductor structure 320, e.g., less than approximately 10 microns. Likewise, the EBD 312 and the sensor 314 are positioned within the housing 360 such that the emission surface 320*b* of the semiconductor structure 320 is in close proximity to the input surface 314*a* of the sensor 314, e.g. 5 mils if the sensor 314 is an integrated circuit and 10 mils if the sensor 314 is a conventional phosphor screen.

In operation, photons (i.e., light) 308 from an image 302 enter the image intensifier 300 through the input side 306*a* of the photo-cathode 306. The photo-cathode 306 changes the entering light into electrons, which are emitted from the output side 306*b* of the photo-cathode 306. Electrons 310 exiting the photo-cathode 306 enter the EBD 312 through the input surface 320*a* of a doped semiconductor structure 320. The electrons 310 from the photo-cathode 306 bombard the input surface 320*a* of the doped semiconductor structure 320, which produces an increased number of electrons near the input surface 320*a* of the semiconductor structure 320. The semiconductor structure 320 includes doped regions for directing the increased number of electrons through the semiconductor structure 320 to an emission area 324 on the emission surface 320*b*. A blocking structure disposed on the semiconductor structure 320 inhibits the emission of electrons from the emission surface 320*b* in areas other than the emission area 324. The EBD 312 emits the increased number of electrons from the emission areas 324 of the emission surface 320*b*. The EBD 312 may generate several hundred electrons in each EBC 332 that receives an electron. Since several hundred electrons may be generated by each EBC 332 within the EBD 312 that receives an electron, the number of electrons exiting the EBD 312 is significantly greater than the number of electrons that entered the EBD 312. The emitted electrons strike the input surface 314*a* of the sensor 314, which generates a representation of an intensified image or converts the electrons into photons of an intensified image 318 for display on a display device 304.

While a particular embodiment of the present invention has been shown and described in detail, adaptations and modifications will be apparent to one skilled in the art. Such adaptations and modifications of the invention may be made without departing from the scope thereof, as set forth in the following claims.

What is claimed is:

1. An electron multiplier apparatus comprising:

a semiconductor structure having an input surface for receiving electrons and an emission surface opposite the input surface, the semiconductor structure generating an increased number of electrons responsive to the received electrons, the semiconductor structure doped to direct the increased number of electrons to at least one emission area on the emission surface, each of the at least one emission areas associated with a corresponding region of the input surface.

2. The apparatus of claim 1; further comprising:

a blocking structure disposed on the emission surface in a blocking area to inhibit the emission of electrons from the emission surface in the blocking area.

3. The apparatus of claim 2, wherein the blocking structure comprises at least:

a first oxide layer disposed on the emission surface to inhibit the emission of electrons from the emission surface in the blocking area;

metal layer disposed on the first oxide layer to draw electrons through the semiconductor structure; and a second oxide layer disposed on the metal layer to inhibit the emission of electrons from the metal layer.

4. The apparatus of claim 2, wherein the blocking structure prevents light from entering the semiconductor structure through the blocking area on the emission surface.

5. The apparatus of claim 1, wherein the doped semiconductor structure comprises at least:

a first doped region in contact with the emission surface, the first doped region extending from the emission surface toward the input surface, wherein the first doped region defines at least one channel that extends to the at least one emission area from the corresponding region of the input surface associated with the at least one emission area to direct the increased number of electrons toward the at least one emission area, the at least one channel having a larger cross-sectional area toward the input surface than at the at least one emission area.

6. The apparatus of claim 5, wherein the semiconductor structure generates the increased number of electrons near the input surface and wherein the doped semiconductor structure further comprises at least:

a second doped region in contact with the input surface, wherein the second doped region forces the increased number of electrons away from the input surface to prevent recombination of the increased number of electrons at the input surface.

7. The apparatus of claim 6, wherein the doped semiconductor structure comprises a gap between the first doped region and the second doped region to provide an effective electron multiplier area on the input surface approaching 100% of the input surface.

8. An electron multiplier method comprising the steps of:

creating an increased number of electrons within a semiconductor device having an input surface and an emission surface opposite the input surface, the increased number of electrons generated in response to electrons impinging the input surface; and directing the increased number of electrons to an emission area for emission from the emission surface.

9. The method of claim 8, further comprising the step of:

blocking the emission of electrons from the emission surface of the semiconductor device in areas other than the emission area.

10. The method of claim 9, further comprising the step of:

blocking the flow of electrons into the emission surface of the semiconductor device in areas other than the emission area.

11. An image intensifier comprising:

a photo-cathode having an input surface for receiving photons of an image and an output surface from which electrons generated by the photo-cathode are emitted, the photo-cathode generating electrons responsive to the photons received at the input surface;

a semiconductor structure having an input surface for receiving the electrons emitted by the photo-cathode and an emission surface opposite the input surface, the semiconductor structure generating an increased number of electrons responsive to the received electrons, the semiconductor structure doped to direct the increased number of electrons to at least one emission area on the emission surface, each of the at least one emission areas associated with a corresponding region of the input surface; and a sensor that receives the increased number of electrons emitted by the emission surface of the semiconductor structure, the sensor configured to produce an intensified representation of the image based on the increased number of electrons.

12. The image intensifier of claim 11, further comprising:

a blocking structure disposed on the emission surface of the semiconductor structure in a blocking area to inhibit the emission of electrons from the emission surface in the blocking area.

13. The image intensifier of claim 12, wherein the blocking structure comprises at least:

a first oxide layer disposed on the emission surface to inhibit the emission of electrons from the emission surface in the blocking area;

a metal layer disposed on the first oxide layer to draw electrons through the semiconductor structure; and a second oxide layer disposed on the metal layer to inhibit the emission of electrons from the metal layer.

14. The image intensifier of claim 11, further comprising:

a vacuum housing for supporting the photo-cathode, semiconductor structure, and imaging device, wherein a first gap exists between the photo-cathode and the semiconductor structure and a second gap exists between the semiconductor structure and the imaging device, the vacuum housing capable of maintaining the first and second gaps under vacuum.

15. The image intensifier of claim 11, wherein the sensor is a phosphor screen and wherein the blocking structure prevents photons emitted from the phosphor screen from entering the semiconductor structure through the blocking area on the emission surface.

16. The image intensifier of claim 11, wherein the doped semiconductor structure comprises at least:

a first doped region in contact with the emission surface, the second doped region extending from the emission surface toward the input surface, wherein the first doped region defines at least one channel that extends to the at least one emission area from the corresponding region of the input surface associated with the at least one emission area to direct the increased number of electrons toward the at least one emission area, the at least one channel having a larger cross-sectional area toward the input surface than at the at least one emission area.

17. The image intensifier of claim 16, wherein the semiconductor structure generates the increased number of electrons near the input surface and wherein the doped semiconductor structure further comprises at least:

a second doped region in contact with the input surface, wherein the second doped region forces the increased number of electrons away from the input surface to prevent recombination of the increased number of electrons at the input surface.

18. The image intensifier of claim 17, wherein the doped semiconductor structure comprises a gap between the first doped region and the second doped region to provide an effective electron multiplier area on the input surface approaching 100% of the input surface.

19. An electron multiplier apparatus comprising:

a semiconductor structure having an input surface for receiving electrons and an emission surface spaced from the input surface, the semiconductor structure generating an increased number of electrons responsive to the received electrons, the semiconductor structure doped to form a plurality of cells, each of the plurality of cells corresponding to a region on the input surface of the semiconductor structure and having a channel associated with the region that directs the increased number of electrons associated with the region to an emission area on the emission surface.

20. The apparatus of claim 19, wherein each of the cells comprises at least:

a first doped region extending from the emission surface toward the input surface, the first doped region defining the channel and the emission area on the emission surface, the channel having a larger cross-sectional area toward the input surface than at the emission area.

21. The apparatus of claim 20, wherein the semiconductor structure generates the increased number of electrons near the input surface and wherein each of the cells further comprises at least:

a second doped region in contact with the input surface, wherein the second doped region forces the increased number of electrons away from the input surface.

22. The apparatus of claim 19, further comprising:

a blocking structure disposed on the emission surface to inhibit the emission of electrons from the emission surface in areas other than the emission areas associated with each of the plurality of cells.

* * * * *